United States Patent [19]

Urakami

[11] Patent Number: 4,563,840

[45] Date of Patent: Jan. 14, 1986

[54] CLEANING PARTICLE IMPINGING DEVICE AND AIR BLAST CLEANING APPARATUS USING SAID DEVICE

[76] Inventor: Fukashi Urakami, 5-21-204 Konandai 4-chome, Konan-ku, Yokohama, Japan

[21] Appl. No.: 538,734

[22] Filed: Oct. 3, 1983

[30] Foreign Application Priority Data

Oct. 11, 1982 [JP] Japan ..... 57-178178

[51] Int. Cl.[4] ..... B24C 5/04

[52] U.S. Cl. ..... 51/410; 51/439; 51/424; 239/120; 239/124

[58] Field of Search ..... 51/410, 439, 424, 425, 51/428, 431, 429, 319; 239/302, 120, 124

[56] References Cited

U.S. PATENT DOCUMENTS 2,723,498 11/1955 Hastrup et al. ..... 51/439
3,034,262 5/1962 Pawlson ..... 51/424
4,095,378 6/1978 Urakami ..... 51/425
4,333,277 6/1982 Tasedan ..... 51/425

*Primary Examiner*—Frederick R. Schmidt
*Assistant Examiner*—Robert A. Rose
*Attorney, Agent, or Firm*—Beveridge, DeGrandi & Weilacher

[57] ABSTRACT

An air blast cleaning apparatus equipped with a device for impinging cleaning particles is provided. The impinging device comprises a first nozzle and a second nozzle. The first nozzle has a first nozzle passage extending from a first inlet portion to a first impinging opening. The second nozzle has a second nozzle passage extending in the impinging direction of the first nozzle from a second inlet portion surrounding the first impinging opening to a second impinging opening. The second nozzle further has an exhaust port located out of alignment with the impinging direction of the first nozzle.

9 Claims, 4 Drawing Figures

CLEANING PARTICLE IMPINGING DEVICE AND AIR BLAST CLEANING APPARATUS USING SAID DEVICE

FIELD OF THE INVENTION

This invention relates to a cleaning particle impinging device for impinging cleaning particles entrained in compressed air against a surface to be cleaned, and to an air blast cleaning apparatus constructed by utilizing such a cleaning particle impinging device.

DESCRIPTION OF THE PRIOR ART

An air blast cleaning apparatus for impinging cleaning particles such as abrasives, steel particles or sand against a surface to be cleaned has been proposed and come into practical acceptance for removing rust, old paint powders, etc. from the surface of a ship, an oil reservoir tank, etc. Such an air blast cleaning apparatus includes a cleaning particle supply source for supplying cleaning particles entrained in compressed air, a cleaning particle impinging device consisting of a nozzle, and a supply pipe extending from the cleaning particle supply source to the cleaning particle impinging device. The compressed air and entrained cleaning particles supplied to the impinging device from the aforesaid supply source through the supply pipe are increased in speed by being passed through the impinging device, and impinged against the surface to be cleaned. Generally, the air blast cleaning apparatus includes a cleaning housing in order to prevent the cleaning particles impinged against the surface to be cleaned and the rust, old paint powder, etc. removed from the cleaned surface from dissipating and contaminating the environment. The cleaning housing is opened on one side. The peripheral edge of the opened one side abuts against the surface to be cleaned and in cooperation with the surface to be cleaned, defines a substantially closed cleaning space. The cleaning particle impinging device is mounted on the cleaning housing with its impinging opening located within the cleaning space, and therefore, impinges compressed air and cleaning particles within the cleaning space.

In the conventional air blast cleaning apparatus described above, the speed and amount of cleaning particles impinged against the surface to be cleaned from the impinging device depend directly upon the speed and amount of compressed air simultaneously impinged against the surface to be cleaned from the impinging device. In order to increase the speed and amount of the cleaning particles to be impinged against the surface to be cleaned, it is necessary to increase the speed and amount of compressed air to be impinged against the surface to be cleaned. If the speed and amount of compressed air to be impinged against the surface to be cleaned are decreased, the speed and amount of the cleaning particles to be impinged against the surface to be cleaned are naturally decreased. It has been found however that various technical advantages can be obtained if the amount of compressed air to be impinged against the surface to be cleaned can be considerably decreased while the reduction of the speed and amount of the cleaning particles to be impinged against the surface to be cleaned is substantially zero or a sufficiently small value.

As disclosed, for example, in U.S. Pat. No. 4,095,378, the cleaning space defined by the cleaning housing and the surface to be cleaned is frequently connected to a suction source through a suction pipe. The suction source sucks air from the cleaning space to form a vacuum in the cleaning space and thus attracts the cleaning housing to the surface to be cleaned. In order to form within the cleaning space a vaccum sufficient to attract the cleaning housing to the surface to be cleaned, air in an amount exceeding the amount of compressed air impinged against the cleaning surface from the impinging device should be sucked by the suction source from the cleaning space. Hence, if the amount of compressed air impinged against the cleaning surface from the impinging device within the cleaning space can be reduced, the amount of air to be sucked from the cleaning space by the suction source can be decreased and therefore, the suction source can be constructed as a less costly device of lower capacity.

As is well known to those skilled in the art, when compressed air is impinged against the cleaning surface from the cleaning particle impinging device, the compressed air is adiabatically expanded, and consequently, steam in the compressed air is converted to dew. The dew is caused to collide with the cleaning surface and adhere to it. The dew adhesion exerts undesirable influences such as acceleration of rust formation at the cleaned surface. The amount of the dew to be caused to collide against the cleaning surface is proportional to the amount of compressed air to be impinged against the cleaning surface. Hence, if the amount of compressed air to be impinged against the surface to be cleaned can be decreased, the amount of dew which collides with the cleaning surface can be decreased.

SUMMARY OF THE INVENTION

It is a primary object of this invention to provide a novel and excellent cleaning particle impinging device for impinging cleaning particles entrained in compressed air against a surface to be cleaned, in which the amount of compressed air to be impinged against the cleaning surface can be considerably decreased while the reduction of the speed and amount of cleaning particles to be impinged against the cleaning surface is substantially zero or a sufficiently small value.

Another object of this invention is to provide an air blast cleaning apparatus provided with the aforesaid novel and excellent cleaning particle impinging device.

Still another object of this invention is to provide an air blast cleaning apparatus in which air is sucked from a cleaning space by utilizing a part of compressed air used for supplying and impinging cleaning particles.

Yet another object of this invention is to provide an air blast cleaning apparatus in which the bouncing motion of cleaning particles which have been impinged against a surface to be cleaned from a cleaning particle impinging device and bounced back from the cleaning surface is utilized for discharging the cleaning particles from the cleaning space.

According to this invention, there is provided a cleaning particle impinging device for impinging cleaning particles entrained in compressed air fed through a supply pipe against a surface to be cleaned, said device comprising a first nozzle means having a first nozzle passage extending from a first inlet portion connected to the downstream end of the supply pipe to a first impinging opening located at the downstream end of the first nozzle passage, and a second nozzle means having a second nozzle passage extending from a second inlet portion surrounding the first impinging opening of the first nozzle means to a second impinging opening located at the downstream end of the second nozzle passage in the impinging direction of the first nozzle means and an exhaust port located out of alignment with the impinging direction of the first nozzle means; the compressed air and cleaning particles to be supplied through the supply pipe being impinged from the first impinging opening through the first nozzle passage, at least a greater portion of the cleaning particles impinged from the first impinging opening and a part of the compressed air impinged from the first impinging opening being impinged from the second impinging opening through the second nozzle passage, and the remainder of the compressed air impinged from the first impinging opening being discharged from the second nozzle passage through the exhaust port.

According to this invention, there is also provided an air blast cleaning apparatus comprising a cleaning housing having one open side, the peripheral edge of said one side abutting against a surface to be cleaned and in cooperation with said surface, defining a substantially closed cleaning space, a cleaning particle impinging device for impinging cleaning particles against said surface to be cleaned, a cleaning particle supply source for supplying cleaning particles entrained in compressed air, and a supply pipe extending from said supply source to said impinging device;

said impinging device including a first nozzle means and a second nozzle means, and said first nozzle means having a first nozzle passage extending from a first inlet portion connected to the supply pipe to a first impinging opening located at the downstream end of the first nozzle passage, and said second nozzle means having a second nozzle passage extending in the impinging direction of the first nozzle means from a second inlet portion surrounding the first impinging opening to a second impinging opening located at the downstream end of the second nozzle passage and within the cleaning space and an exhaust port located outside the cleaning space out of alignment with the impinging direction of the first nozzle means;

the compressed air and cleaning particles to be supplied through the supply pipe being impinged from the first impinging opening through the first nozzle passage, at least a greater portion of the cleaning particles impinged from the first impinging opening and a part of the compressed air impinged from the first impinging opening being impinged from the second impinging opening through the second nozzle passage toward said surface to be cleaned, and the remainder of the compressed air impinged from the first impinging opening being discharged from the second nozzle passage through the exhaust port.

Other objects of this invention and various advantages brought about by this invention will become apparent from the following description.

DETAILED DESCRIPTION OF PREFERRED EMBODIMENTS

The present invention will be described in detail below with reference to the accompanying drawings showing the specific embodiments of this invention.

Figure 1:
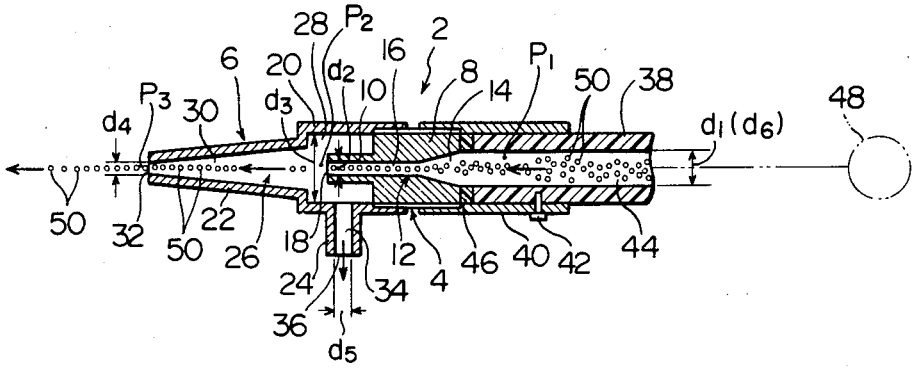
FIG. 1 is a sectional view showing one embodiment of the cleaning particle impinging device constructed in accordance with this invention.

Referring to FIG. 1 which illustrates one embodiment of the cleaning particle impinging device constructed in accordance with this invention, the illustrated cleaning particle impinging device shown generally at 2 is constructed of a first nozzle means 4 and a second nozzle means 6.

The first nozzle means 4 has a cylindrical main portion 8 having a relatively large diameter and a cylindrical front end portion 10 having a relatively small diameter. The main portion 8 and the front end portion 10 which can be formed as an integral one-piece unit are conveniently fromed of a rigid material having excellent abrasion resistance, such as sintered tungsten carbide or sintered boron carbide. The first nozzle means 4 defines a first nozzle passage 12 extending axially from its rear end (the right end in FIG. 1) to its front end (the left end in FIG. 1). The first nozzle passage 12 has a first inlet portion 14 tapered so that it progressively decreases in inside diameter from its relatively large inside diameter $d_1$ toward the downstream side and therefore progressively decreasing in sectional area, and a main portion 16 extending from the first inlet portion 14. A first impinging opening 18 is formed at the downstream end of the main portion 16 having a relatively small inside diameter $d_2$.

The second nozzle means 6 has a cylindrical downstream portion 20 having a relatively large diameter and a hollow truncated conical main portion 22 progressively decreasing in outside diameter toward its downstream end. The second nozzle means 6 further includes a cylindrical branched portion 24 of a relatively small diameter extending laterally with respect to its axial direction from the downstream portion 20. The downstream portion 20, the main portion 22 and the branched portion 24 which can be formed as an integral one-piece unit are also conveniently formed of a rigid material having excellent abrasion resistance, such as sintered tungsten carbide or sintered boron carbide. The downstream portion 20 and the main portion 22 of the second nozzle means 6 defines a second nozzle passage 26 extending axially. The second nozzle passage 26 has an inlet portion 28 defined by the downstream portion 20 and having a relatively large inside diameter $d_3$ and a main portion 30 of a tapered shape defined by the main portion 22 and decreasing progressively in inside diameter and therefore in sectional area toward the downstream side. A second impinging opening 32 having a relatively small inside diameter $d_4$ is formed at the downstream end of the tapered main portion 30. The branched portion 24 of the second nozzle means 6 defines a branched passage 34 communicating with the second inlet portion 28. An exhaust port 36 is formed at the downstream end of the branched passage 34 having a relatively small inside diameter $d_5$.

The first nozzle means 4 is connected to a supply pipe 38, and the second nozzle means 6, to the first nozzle means 4. In more detail, in the illustrated embodiment, the first nozzle means 4 is connected to the supply pipe 38 by means of a connecting sleeve 40. An external thread is formed on the peripheral surface of the cylindrical main portion 8 of the first nozzle means 4, and an internal thread is formed at the downstream portion (the left portion in FIG. 1) of the inner circumferential surface of the connecting sleeve 40 having an inside diameter corresponding to the outside diameter of the cylindrical main portion 8. The first nozzle means 4 and the connecting sleeve 40 are connected to each other by fitting the external thread with the internal thread. On the other hand, the supply pipe 38 has an outside diameter corresponding to the inside diameter of the connecting sleeve 40. By inserting the downstream end portion of the supply pipe 38 into the upstream portion (the right-hand portion in FIG. 1) of the connecting sleeve 40 and securing a plurality of setscrews 42 (only one of them is shown in FIG. 1) to the supply pipe 38 through the connecting sleeve 40 perpendicularly to the axial direction, the connecting sleeve 40 and the downstream end portion of the supply pipe 38 are connected to each other. When the first nozzle means 4 is thus connected to the downstream end of the supply pipe 38, the first inlet portion 14 of the first nozzle passage 12 in the first nozzle means 4 is connected to the downstream end of a supply passage 44 in the supply pipe 38. Conveniently, the inside diameter $d_6$ of the supply passage 44 in the supply pipe 38 is substantially equal to the inside diameter $d_1$ of the upstream end of the nozzle passage 12 in the first nozzle means 4. Between the downstream end of the supply pipe 38 and the upstream end of the first nozzle means 4, an annular seal member 46 having substantially the same inside diameter as the inside diameter $d_1$ and the inside diameter $d_6$ may be interposed. The seal member 46 can be formed of a flexible material having excellent abrasion resistance such as a urethone rubber. The inside diameter $d_3$ of the cylindrical downstream portion 20 of the second nozzle means 6 corresponds to the outside diameter of the cylindrical main portion 8 of the first nozzle means 4, and an internal thread is formed in the downstream end portion of the inner circumferential surface of the cylindrical downstream portion 20. The second nozzle means 6 is connected to the downstream side of the first nozzle means 4 by fitting the internal thread formed at the downstream end portion of the inner circumferential surface of the cylindrical downstream portion 20 of the second nozzle means 6 with the thread formed on the peripheral surface of the cylindrical main portion 8 of the first nozzle means 6. As a result, as clearly shown in FIG. 1, the second inlet portion 28 of the second nozzle passage 26 surrounds the first impinging opening 18 of the first nozzle means 4. It is important that the second nozzle passage 26 in the second nozzle means 6 should extend in the impinging direction of the first nozzle means 4. Preferably, the first nozzle passage 12 in the first nozzle means 4 and the second nozzle passage 26 in the second nozzle means 6 should be in alignment with each other and extend in a straight line. On the other hand, it is important that the branched passage 34 in the second nozzle means 6 and the exhaust port 36 located at its downstream end should be out of alignment with the impinging direction of the first nozzle means 4. In the illustrated embodiment, the cylindrical branched portion 24 of the second nozzle means 6 extends substantially perpendicular to the cylindrical downstream portion 20, and therefore, the branched passage 34 is turned substantially by 90° away from the impinging direction.

Conveniently, the supply pipe 38 is formed of a flexible material having excellent abrasion resistance such as natural or synthetic rubbers. As illustrated simply in FIG. 1, the upstream end of the supply pipe 38 is connected to a cleaning particle supply source 48 for supplying cleaning particles with compressed air. The cleaning particle supply source 48 may be of a known type including an air compressor and a cleaning particle hopper. Cleaning particles 50 to be supplied with compressed air may be any suitable particles such as abrasives, steel particles or sand.

The operation of the cleaning particle impinging device 2 comprised of the first nozzle means 4 and the second nozzle means 6 will now be described. Compressed air and the cleaning particles 50 entrained in it which are supplied from the supply source 48 to the impinging device 2 through the supply pipe 38 undergo a so-called contracting action by being passed through the first nozzle passage 12 and is accelerated, and is consequently impinged at high speeds from the first impinging opening 18. Then, substantially all of the cleaning particles 50 impinged at high speeds from the first impinging opening 18, because of their relatively large mass, go straight-forwardly by the action of inertia, pass through the second nozzle passage 26, and are impinged at high speeds from the second impinging opening 32. The cleaning particles 50 impinged from the first impinging opening 18 tend to advance downstream while slightly diffusing. This tendency, however, is corrected while the particles 50 pass through the tapered main portion 30 of the second nozzle passage 26. On the other hand, compressed air impinged at high speeds from the first impinging opening 18 is branched into two streams. A part of the compressed air from the first impinging opening 18 passes through the second nozzle passage 26 as do the cleaning particles 50, and is impinged from the second impinging opening 32. However, the remainder of the compressed air from the first impinging opening 18 flows into the branched passage 34 from the inlet portion 28 of the second nozzle passage 26 and is discharged from the exhaust port 36. Thus, according to the cleaning particle impinging device 2 constructed in accordance with this invention, the amount of the compressed air to be impinged from the second impinging opening 32 against a surface to be cleaned can be decreased by an amount corresponding to the compressed air discharged from the exhaust port 36 through the branched passage 34 while the reduction of the speed and amount of the cleaning particles 50 impinged from the second impinging opening 32 against the surface to be cleaned is substantially zero or a sufficiently small value.

In order that a part of the compressed air from the first impinging opening 18 may be discharged from the exhaust port 36 through the branched passage 34, the following condition should be satisfied. The amount of compressed air ($V_1$) passing through the first nozzle passage 12 is given by the following equation.

$$V_1 = KA_1\sqrt{P_1 - P_2}$$

where $P_1$ is the pressure of the upstream side of the first nozzle passage 12, $P_2$ is the pressure of the downstream side of the first nozzle passage 12, i.e. the pressure of the upstream side of the second nozzle passage 26, $A_1$ is the minimum sectional area of the first nozzle passage 12, and K is a constant inherent to the compressed air.

On the other hand, the amount of compressed air ($V_2$) passing through the second nozzle passage 26 is given by the following equation.

$$V_2 = KA_2\sqrt{P_2 - P_3}$$

where $P_3$ is the pressure of the downstream side of the second nozzle passage 26 and $A_2$ is the minimum sectional area of the second nozzle passage 26.

In FIG. 1, $P'_3$ is the atmospheric pressure. If the amount of compressed air $V_1$ passing through the first nozzle passage 12 is larger than the amount of compressed air $V_2$ passing through the second nozzle passage 26 and $V_1 - V_2 = V_3$, compressed air in the amount $V_3$ is discharged from the exhaust port 36 through the branched passage 34. Hence, the condition $V_1 > V_2$ should be satisfied. Hence, the following condition should be satisfied.

$$KA_1\sqrt{P_1 - P_2} > KA_2\sqrt{P_2 - P_3}$$

therefore, $$A_1\sqrt{P_1 - P_2} > A_2\sqrt{P_2 - P_3}\ .$$

It will be readily appreciated that if the above condition is satisfied and $V_1$ is greater than $V_2$, the pressure $P_2$ is higher than the atmospheric pressure. To satisfy the above condition $$A_1\sqrt{(P_1 - P_2)} > A_2\sqrt{(P_2 - P_3)}\ ,$$

the inside diameter $d_4$ of the second impinging opening 32 should not be excessively large for the inside diameter $d_2$ of the first impinging opening 18. If the inside diameter $d_4$ of the second impinging opening 32 is excessively large, $$A_1\sqrt{(P_1 - P_2)} < A_2\sqrt{(P_2 - P_3)}\ ,$$

and $V_1 < V_2$. In this case, the pressure $P_2$ becomes smaller than the atmospheric pressure, and the second nozzle means 6 functions as an ejector. As a result, air is sucked into the second nozzle passage 26 from the surrounding atmosphere through the exhaust port 36 and the branched passage 34. The sucked air is added to the compressed air impinged from the first impinging opening 18 and impinged from the second impinging opening 32.

Experiments conducted by the present inventor have led to the determination that if the inside diameter $d_4$ of the second impinging opening 32 is made substantially equal to the inside diameter $d_2$ of the first impinging opening, the above condition $$A_1\sqrt{(P_1 - P_2)} > A_2\sqrt{(P_2 - P_3)}$$

can be easily satisfied. One example of the experiments conducted by the present inventors is shown below. In the cleaning particle impinging device 2 shown in FIG. 2, $d_1$ to $d_5$ were set as follows:

$d_1 = 25$ mm,
$d_2 = 12$ mm,
$d_3 = 45$ mm,
$d_4 = 12$ mm,
$d_5 = 14$ mm.

Compressed air and cleaning particles 50 entrained in it were supplied to the cleaning particle impinging device 2 through the supply pipe 38 from the supply source 48 so that $P_1$ was 6.5 kg/cm$^2$. At this time, the measured value of $P_2$ was 1.5 kg/cm$^2$. The measured amount of compressed air impinged from the second impinging opening 32 was 3 m$^3$/min., and the measured amount of compressed air discharged from the exhaust port 36 was 4.5 m$^3$/min. Furthermore, in order to examine changes in the speed and amount of the cleaning particles 50 impinged from the second impinging opening 32 as a result of discharging a part of the compressed air impinged from the first impinging opening 18 from the exhaust port 36 through the branched passage 34, the following experiment was carried out. The second nozzle means 6 was detached from the first nozzle means 4, and the cleaning particles 50 impinged from the first impinging opening 18 were caused to collide directly with a surface to be cleaned. Then, the second nozzle means 6 was connected in position to the first nozzle means 4, and the cleaning particles 50 were impinged from the first impinging opening 18, passed through the second nozzle passage 26, then impinged from the second impinging opening 32, and caused to collide against the surface to be cleaned. The cleaning effect of the cleaning particles 50 on the cleaning surface was examined in both cases, and the results were compared. It was found that there was substantially no difference in effect between the two cases. It was therefore confirmed that even when more than half of the compressed air impinged from the first impinging opening 18 is discharged from the exhaust port 36 through the branched passage 34, there is substantially no decrease in the speed and amount of the cleaning particles 50 impinging from the second impinging opening 32, or if there is any decrease, it is very small.

Figure 2:
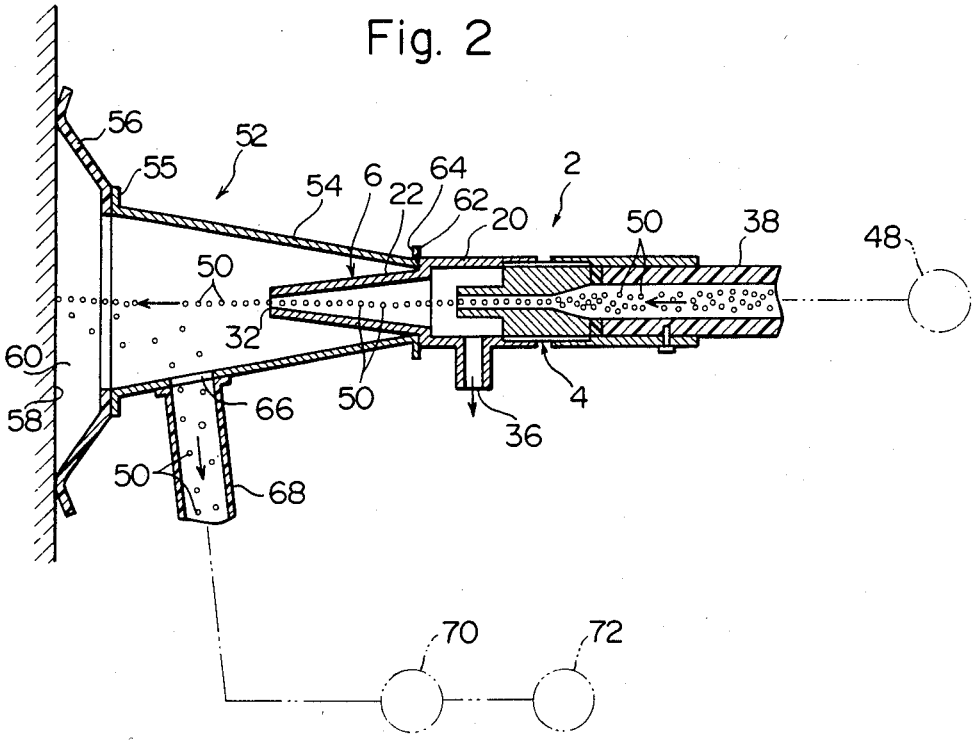
FIG. 2 is a sectional view showing a first embodiment of the air blast cleaning apparatus equipped with the cleaning particle impinging device shown in FIG. 1.

FIG. 2 shows a first embodiment of an air blast cleaning apparatus equipped with the cleaning particle impinging device 2 described hereinabove. The illustrated apparatus has a cleaning housing generally shown at 52. The cleaning housing 52 has a main portion 54 of a nearly hollow truncated conical shape. The main portion 54 may be formed of a rigid or semirigid material such as a steel sheet. An annular flange 55 is formed at the front end (the left end in FIG. 2) of the main portion 54, and to the annular flange 55 is fixed, by a suitable means such as bonding, the rear end of a seal wall 56 of a nearly hollow truncated conical shape extending forwardly therefrom. Conveniently, the seal wall 56 is formed of a flexible material such as natural or synthetic rubbers. The cleaning particle impinging device 2 is described hereinabove with reference to FIG. 1 is mounted on the rear end (the right end in FIG. 2) of the main portion 54. It will be readily appreciated from FIG. 2 that the cleaning housing 52 comprised of the main portion 54 and the seal wall 56 has an opening at its front side, and when the peripheral edge of this open front side, i.e. the free end portion of the seal wall 56, abuts against a surface 58 to be cleaned, for example the surface of a ship or an oil reservoir tank, it defines a substantially closed cleaning space 60 in cooperation with the cleaning surface 58. It is important that the cleaning particle impinging device 2 mounted on the rear end of the cleaning housing 52 should be positioned such that its second impinging opening 32 is within the cleaning space 60 and its exhaust port 36 is outside of the cleaning space 60. In the illustrated embodiment, the impinging device 2 is fixedly secured to the cleaning housing 52 by fixing a forwardly facing annular shoulder portion 62 existing in the boundary between the cylindrical downstream portion 20 of the second nozzle means 6 and the hollow truncated conical main portion 22 to an annular flange 64 formed at the rear end of the main portion 54 of the cleaning housing 52 by a suitable means such as welding or clamping by a bolt and nut. Thus, the second impinging opening 32 is positioned within the cleaning space 60 and the exhaust port 36, outside of the cleaning space. In the illustrated embodiment, a suction opening 66 is further formed in the main portion 54 of the cleaning housing 52. One end of a suction pipe 68 conveniently formed of a flexible material such as natural or synthetic rubbers is connected to the suction opening 66. As shown in a simplified form in FIG. 2, the other end of the suction pipe is connected to a suction means 72 which may be a suction pump via a separator-collector 70 known per se.

In the air blast cleaning apparatus described above, air is sucked from the cleaning space 60 through the suction pipe 68 by the action of the suction means 72 to create a vacuum in the cleaning space 60. As a result, the cleaning housing 52 and the impinging device 2 mounted thereon are attracted by vacuum to the cleaning surface 58. If desired, as disclosed in the applicant's U.S. Pat. No. 4,095,378, the cleaning housing 52 and the impinging device 2 mounted thereon, which are attracted by vacuum to the cleaning surface 58, may be caused to travel along the cleaning surface 58 by fixing a supporting frame to the main portion 54 of the cleaning housing 52, mounting on the supporting frame rotating wheels to be contacted with the cleaning surface and a drive source for driving these wheels, and rotating the wheels by the drive source.

As already stated hereinabove, compressed air and the cleaning particles 50 entrained in it are supplied to the impinging device 2 mounted on the cleaning housing 52 from the supply source 48 through the supply pipe 38. The cleaning particles 50 are impinged against the cleaning surface 58 from the second impinging opening 32, and consequently, the cleaning surface 58 is cleaned. On the other hand, a part of compressed air is impinged against the cleaning surface 58 from the second impinging opening 32 together with the cleaning particles 50. The remainder of the compressed air is discharged into the atmosphere outside the cleaning space 60 from the exhaust port 36. If the dust is entrained in the compressed air to be supplied to the impinging device together with the cleaning particles 50 and is discharged together with the compressed air from the exhaust port 36, it is possible to provide at the exhaust port 36 a dust collector (not shown) capable of separating the dust from the air and collecting it.

The cleaning particles 50 impinged against the cleaning surface 58 from the second impinging opening 32 of the impinging device 2 and the dust such as rust and old paint powder removed from the cleaning surface 58 by the action of the impinged cleaning particles 50 is confined within the cleaning space 60 without dissipation. They are withdrawn from the cleaning space 60 while being carried on the air stream sucked from the space 60 through the suction pipe 68, and are separated from the air stream by the separator-collector 70. The cleaning particles 50 collected by the separator-collector 70 can be recycled to the cleaning particle supply source 48 for reuse.

According to the air blast cleaning apparatus described above, a part of the compressed air supplied to the impinging device 2 is discharged into the atmosphere from the exhaust port 36 without being impinged into the cleaning space 60 from the second impinging opening 32. Accordingly, the amount of air to be sucked from the cleaning space 60 through the suction pipe 68 so as to create a vacuum in the cleaning space 60 can be smaller by the amount of air discharged into the atmosphere from the exhaust port 36, and therefore, the suction means 72 may be of relatively low capacity and less costly.

Figure 3:
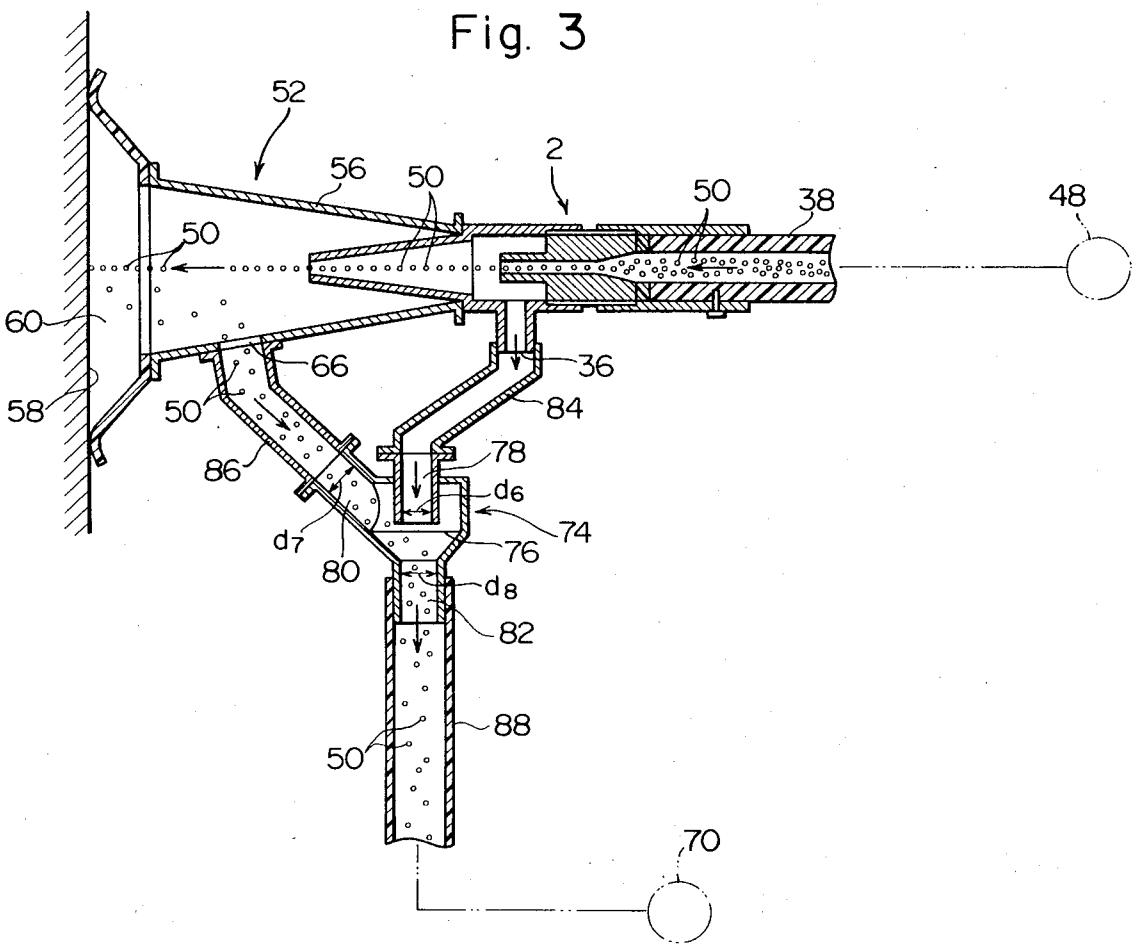
FIG. 3 is a sectional view showing a second embodiment of the air blast cleaning apparatus equipped with the cleaning particle impinging device shown in FIG. 1.

FIG. 3 illustrates a second embodiment of the air blast cleaning apparatus equipped with the impinging device 2 described hereinabove in detail. The second embodiment includes an ejector generally shown at 74. The ejector 74 has a mixing portion 76, a nozzle portion 78, a suction portion 80 and a diffuser portion 82. The mixing portion 76 consists of a casing having a hollow truncated conical shape with its upper half being cylindrical and its lower half progressively decreasing in inside diameter downwardly. The nozzle portion 78 consisting of a tubular member having a relatively small inside diameter $d_6$ is fixed to the mixing portion 76 by inserting its downstream portion into the mixing portion 76 through an opening formed in the upper wall of the mixing portion 76. The suction portion 80 consisting of a tubular member having an inside diameter $d_7$ is fixed to the mixing portion 76 with its downstream end being in alignment with an opening formed in the side wall of the mixing portion 76. The diffuser portion 82 consisting of a tubular member having a relatively large inside diameter $d_8$ is fixed to the mixing portion76 with its upstream end being in alignment with an opening formed in the bottom surface of the mixing portion 76. The downstream end of an exhaust pipe 84 is connected to the upstream end of the nozzle portion 78, and the upstream end of the exhaust pipe 84 is connected to the exhaust port 36 of the impinging device 2. Thus, the nozzle portion 78 is caused to communicate with the exhaust port 36 of the impinging device 2 via the exhaust pipe 84. To the upstream end of the suction portion 80 is connected the downstream end of a suction pipe 86. The upstream end of the suction pipe 86 is connected to the suction opening 66 formed in the main portion 54 of the housing 52. Thus, the suction portion 80 is caused to communicate with the cleaning space 60 via the suction pipe 86. The exhaust pipe 84 and the suction pipe 86 may be formed of a rigid or semirigid material or a flexible material. The upstream end of a delivery tube 88 is connected to the downstream end of the diffuser portion 82. Conveniently, the delivery tube 88 is formed of a flexible material such as natural or synthetic rubbers. As shown in a simplified form in FIG. 3, the downstream end of the delivery pipe 88 is open to the atmosphere via the separator-collector 70.

In the second embodiment described above, compressed air discharged from the exhaust port 36 of the impinging device 2 flows into the nozzle portion 78 of the ejector 74 via the exhaust pipe 84 and then via the mixing portion 76 and the diffuser portion 82 of the ejector 74, into the delivery pipe 88. As a result, a vacuum is formed in the mixing portion 76 of the ejector 74, and the air within the cleaning space 60 is sucked into the suction portion 80 of the ejector 74 through the suction pipe 86. Then, the sucked air flows into the delivery pipe 88 via the mixing portion 76 and the diffuser portion 82 of the ejector 74. In order that an air stream as above may be formed in the ejector 74 or in other words the ejector 74 may function as an ejector, the sectional area of the diffuser portion 82 should be larger than that of the nozzle portion 78. The sectional area of the suction portion 80 may be set properly.

Experiments of the present inventor have shown that the air stream sucked from the cleaning space 60 via the suction pipe 86 by the action of the ejector 74 was sufficient to entrain the cleaning particles 50 and the dust such as rust and old paint powder removed from the cleaning surface 58 and discharge them from the cleaning space 60, but was insufficient to create within the cleaning space 60 a vacuum high enough to attract the cleaning housing 52 and the impinging device 2 mounted thereon to the cleaning surface 58 by vacuum. Accordingly, when it is desired to attract the cleaning housing 52 and the impinging device 2 mounted thereon to the cleaning surface 58 by creating a sufficient vacuum within the cleaning space 60, it would generally be necessary to provide a suction means (not shown in FIG. 3) at the downstream end of the delivery pipe 88 and suck air from the cleaning space 60 via the suction pipe 86, the ejector 74 and the delivery pipe 88 by the action of both the ejector 74 and the suction means. Such a suction means, however, is not necessary when the cleaning housing 52 and the impinging device 2 mounted thereon are positioned in place with respect to the cleaning surface 58 by suspending them with a suspending means (not shown) such as a wire rope.

Except as described above, the structure, operation and advantage of the second embodiment shown in FIG. 3 are substantially the same as those of the first embodiment shown in FIG. 2.

Figure 4:
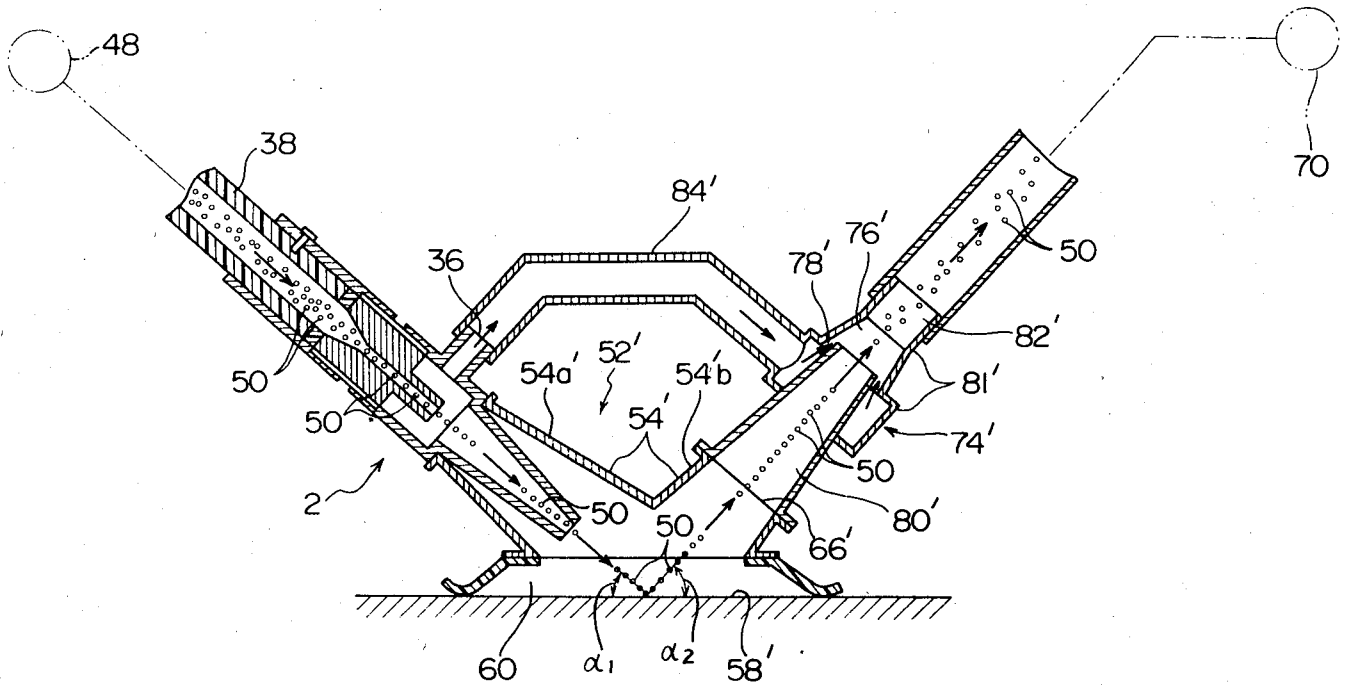
FIG. 4 is a sectional view showing a third embodiment of the air blast cleaning apparatus equipped with the cleaning particle impinging device shown in FIG. 1.

FIG. 4 shows a third embodiment of the air blast cleaning apparatus equipped with the impinging device shown in FIG. 1 and described hereinabove in detail. The third embodiment is especially suitable for cleaning a substantially horizontal surface 58' such as a ship's deck. In the third embodiment, the main portion 54' of the cleaning housing 52' is nearly V-shaped with the provision of two leg portions 54'*a* and 54'*b* extending from its open bottom surface. The impinging device 2 is mounted on the upper end of one leg portion 54'*a*. A suction opening 66' is formed in the upper end of the other leg portion 54'*b*. The impinging device 2 impinges the cleaning particles 50 in the extending direction of the one leg portion 52'*a* and therefore in a direction inclined to the cleaning surface 58' at an angle $\alpha_1$. The other leg portion 54'*b* extends inclinedly at an angle of $\alpha_2(\alpha_1=\alpha_2)$ to the cleaning surface 58', namely in the bouncing direction of the cleaning particles which bounce upon collision with the cleaning surface 58'.

Furthermore, in the third embodiment shown in FIG. 4, an ejector 74' of a slightly different form from the ejector 74 in the second embodiment shown in FIG. 3 is used. The ejector 74' has a casing 81' and a suction portion 80' extending at an angle $\alpha_2$ to the cleaning surface 58' following the leg portion 54'*b* in the main portion 54' of the cleaning housing 52'. The casing 81' has a cylindrical upstream portion of a relatively large diameter and a nearly cylindrical downstream portion of a relatively small diameter. The upstream side of the cylindrical downstream portion is somewhat tapered in the downstream direction. The downstream portion of the suction portion 80' constructed of a truncated conical hollow member somewhat tapered in the downstream direction is inserted into the casing 81' via an opening formed in the upstream wall of the casing 81'. The upstream end of the suction portion 80' is connected directly to the suction opening 66' in the cleaning housing 52'. An influent opening is formed in the side wall of the cylindrical upstream portion of the casing 81', and the downstream end of the exhaust pipe 84' is connected to the influent opening. The upstream end of the exhaust pipe 84' is connected to the exhaust port 36 of the impinging device 2. In the ejector 74' described above, an annular flow passage defined between the peripheral surface of the downstream end of the truncated conical hollow member constituting the suction portion 80' and the inner circumferential surface of the upstream end of the nearly cylindrical downstream portion of the casing 81' defines a nozzle portion 78'. The upstream half of the nearly cylindrical downstream portion of the casing 81' defines a mixing portion 76', and the downstream half of the nearly cylindrical downstream portion of the casing 81' defines a diffuser portion 82'. As stated hereinabove, in order for the ejector 74' to function as an ejector, the sectional area of the diffuser portion 82' should be larger than that of the annular flow passage defining the nozzle portion 78'.

In the third embodiment described above, compressed air discharged from the exhaust port 36 of the cleaning particle impinging device 2 flows into the casing 81' via the exhaust pipe 84', and then via the nozzle portion 78', the mixing portion 76' and the diffuser portion 82', into the delivery pipe 88. In the second embodiment shown in FIG. 3 and described hereinabove which is particularly suitable for cleaning an upstanding or inclined surface 58, the flowing of the cleaning particles 50 in the cleaning space 60 into the suction opening 66 is facilitated by the gravity acting on the cleaning particles 50 themselves, as can be easily understood from FIG. 3. In contrast, it is easily understood from FIG. 4 that in the third embodiment shown in FIG. 4, the flowing of the cleaning particles 50 in the cleaning space 60 into the suction opening 66' is not facilitated by the gravity acting on the cleaning particles 50, but the gravity acting on the cleaning particles 50 themselves acts to hamper the flowing of the particles 50 into the suction opening 66'. However, as can be easily seen from FIG. 4, in the third embodiment, the flowing of the cleaning particles 50 into the suction opening 66' is promoted by the bouncing motion of the cleaning particles 50 which bounce upon collision with the cleaning surface 58'. Accordingly, in the third embodiment shown in FIG. 4, too, the cleaning particles 50 and the dust such as rust and old paint powder removed from the surface 58' can be discharged accurately by the action of the air stream sucked from the cleaning space 60 under the action of the ejector 74'. On the other hand, in the third embodiment, the cleaning housing 52' and the impinging device 2 mounted thereon are located on the cleaning surface 58' by the gravity acting on themselves. It is not necessary therefore to create a sufficient vacuum in the cleaning space 60 and attract the cleaning housing 52' and the impinging device 2 to the surface 58' by vacuum.

Except as described above, the structure, operation and advantage of the third embodiment shown in FIG. 4 are substantially the same as those of the second embodiment shown in FIG. 3.

While the present invention has been described in detail hereinabove with reference to the accompanying drawings, it should be understood that the invention is not limited to the specific embodiments described and shown in these drawings, and various changes and modifications are possible without departing from the scope of the invention.

What is claimed is:

1. A cleaning particle impinging device for impinging cleaning particles entrained in compressed air fed through a supply pipe against a surface to be cleaned, said device comprising a first nozzle means having a first nozzle passage extending from a first inlet portion connected to the downstream end of the supply pipe to a first impinging opening located at the downstream end of the first nozzle passage, and a second nozzle means having a second nozzle passage extending from a second inlet portion surrounding the first impinging opening of the first nozzle means to a second impinging opening located at the downstream end of the second nozzle passage in the impinging direction of the first nozzle means and an exhaust port located out of alignment with the impinging direction of the first nozzle means; the compressed air and cleaning particles to be supplied through the supply pipe being impinged from the first impinging opening through the first nozzle passage, at least a greater portion of the cleaning particles impinged from the first impinging opening and a part of the compressed air impinged from the first impinging opening being impinged from the second impinging opening through the second nozzle passage, and the remainder of the compressed air impinged from the first impinging opening being discharged from the second nozzle passage through the exhaust port.

2. The impinging device of claim 1 wherein the second inlet portion of the second nozzle passage has a relatively large sectional area, and the main portion of the second nozzle passage which extends from the second inlet portion to the second impinging opening is of a tapered shape progressively decreasing in sectional area in the downstream direction.

3. The impinging device of claim 2 wherein the exhaust port is formed at the second inlet portion of the second nozzle passage.

4. An air blast cleaning apparatus comprising a cleaning housing having one open side, the peripheral edge of said one side abutting against a surface to be cleaned and in cooperation with said surface, defining a substantially closed cleaning space, a cleaning particle impinging device for impinging cleaning particles against said surface to be cleaned, a cleaning particle supply source for supplying cleaning particles entrained in compressed air, and a supply pipe extending from said supply source to said impinging device;

said impinging device including a first nozzle means and a second nozzle means, and said first nozzle means having a first nozzle passage extending from a first inlet portion connected to the supply pipe to a first impinging opening located at the downstream end of the first nozzle passage, and said second nozzle means having a second nozzle passage extending in the impinging direction of the first nozzle means from a second inlet portion surrounding the first impinging opening to a second impinging opening located at the downstream end of the second nozzle passage and within the cleaning space and an exhaust port located outside the cleaning space out of alignment with the impinging direction of the first nozzle means;

the compressed air and cleaning particles to be supplied through the supply pipe being impinged from the first impinging opening through.the first nozzle passage, at least a greater portion of the cleaning particles impinged from the first impinging opening and a part of the compressed air impinged from the first impinging opening being impinged from the second impinging opening through the second nozzle passage toward said surface to be cleaned, and the remainder of the compressed air impinged from the first impinging opening being discharged from the second nozzle passage through the exhaust port.

5. The cleaning apparatus of claim 4 wherein the second inlet portion of the second nozzle passage has a relatively large sectional area, and the main portion of the second nozzle passage which extends from the second inlet portion to the second impinging opening is of a tapered shape progressively decreasing in sectional area in the downstream direction.

6. The cleaning apparatus of claim 5 wherein the exhaust port is formed at the second inlet portion of the second nozzle passage.

7. The cleaning apparatus of claim 4 wherein the apparatus further comprises a suction means and a suction pipe communicating said suction means with said cleaning space, and by sucking air within the cleaning space through the suction pipe by the action of the suction means, a vacuum is created in the cleaning space and the cleaning particles within the cleaning space are caused to flow out from the cleaning space while being entrained in the air sucked from the cleaning space.

8. The cleaning apparatus of claim 4 wherein said apparatus further comprises an ejector having a nozzle portion, a suction portion and a diffuser portion; the nozzle portion communicates with the exhaust port and the suction portion communicates with the cleaning space; and compressed air discharged through the exhaust port comes into the nozzle portion and flows through the diffuser portion whereby air is sucked into the suction portion from the cleaning space and flows through the diffuser portion, and the cleaning particles within the cleaning space are caused to flow out from the cleaning space while being entrained in the air sucked from the cleaning space.

9. The cleaning apparatus of claim 8 wherein the impinging device impinges the cleaning particles in a direction inclined to said cleaning surface, and the flow path of air sucked from the cleaning space through the suction portion of the ejector extends in the bouncing direction of the cleaning particles which bounce upon collision with the cleaning surface.

* * * * *